United States Patent [19]

Mesek

[11] 4,302,853

[45] Dec. 1, 1981

[54] DISPOSABLE UNDERGARMENT

[75] Inventor: Frederick K. Mesek, Oak Forest, Ill.

[73] Assignee: Johnson & Johnson Baby Products Company, New Brunswick, N.J.

[21] Appl. No.: 153,376

[22] Filed: May 27, 1980

[51] Int. Cl.[3] ..... A41B 9/04

[52] U.S. Cl. ..... 2/402; 2/406; 128/288

[58] Field of Search ..... 2/406, 407, 403, 404, 2/DIG. 7, 111, 69, 109, 402; 128/288, 287, 284

[56] References Cited

U.S. PATENT DOCUMENTS

| | | | |
|---|---|---|---|
| 3,237,625 | 3/1966 | Johnson | 2/406 X |
| 3,390,218 | 6/1968 | Painter et al. | 223/30 X |
| 3,556,921 | 1/1971 | Painter et al. | 428/181 X |
| 3,599,640 | 8/1971 | Larson | 2/406 X |
| 3,613,119 | 10/1971 | Sarmiento | 2/407 |
| 3,613,687 | 10/1971 | Kennedy | 2/406 X |
| 3,629,871 | 12/1971 | Sarmiento | 2/407 |
| 3,663,962 | 5/1972 | Burger | 2/406 |
| 3,739,398 | 6/1973 | Sarmiento | 2/407 |
| 4,205,679 | 6/1980 | Repke et al. | 128/287 |

*Primary Examiner*—H. Hampton Hunter

*Attorney, Agent, or Firm*—Martha A. Michaels

[57] ABSTRACT

A disposable undergarment particularly suitable for the toilet training of infants is provided. The undergarment is fabricated from a compressively shrunk non-woven fabric in a single layer or laminated to provide multiple layers. The undergarment is made from a single blank of substantially rectangular shape of which one longer side margin is adapted to become the waist encircling portion of the undergarment, and the other side margin is adapted to become the leg openings. Joining all layers of the fabric together in the crotch area provides leg apertures when the undergarment is formed from the blank.

18 Claims, 12 Drawing Figures

DISPOSABLE UNDERGARMENT

BACKGROUND OF THE INVENTION

In recent years, disposable diapers have met with increased commerical acceptance primarily because of their convenience as opposed to cloth diapers which need to be laundered once soiled. There exists, however, a need for a disposable training panty which can be used during the transition period between diapers and reusable undergarments.

Currently available training pants are generally made from knitted or woven cloth, such as cotton, or cotton-polyester blends. They may or may not include additional absorbent layers in the crotch area and they may include a water-repellent outer layer. Non-disposable training pants are disclosed, for example, in U.S. Pat. Nos. 2,733,715; 3,237,625; 3,368,563; 3,530,859; and 3,613,687.

The prior art and commercially available training pants suffer from a number of disadvantages, however. Aside from the obvious disadvantage of having to be laundered, the primary disadvantage of the currently available conventional cloth training panty is the problem of liquid strikethrough. The prior art has attempted to solve this problem by providing areas of extra absorbency utilizing, for example, terrycloth or a piled fabric in the crotch portion of the panty and/or additionally including a water-repellent outer layer in the crotch area, or over the entire outer surface of the panty. However, as anyone knows who has ventured through the traumatic training period with their babies, the prior art simply has not provided a satisfactory solution.

For the above reasons, many mothers continue to use diapers during the training period, rather than suffer the annoyance of liquid strikethrough when their child has an accident. While the use of diapers substantially reduces the problem of liquid strikethrough, diaper use during the training period is highly undesirable and tends to prolong the period required to completely train the child. Psychologically, it is desirable for children to be in panties during the training period so they are aware of no longer being babies and are more aware of accidents.

Aside from the undesirable psychological drawbacks of continuing to use diapers during the training period, disposable diapers present an economic drawback. Disposable diapers generally utilize tape tab fasteners in place of safety pins and fastening means. When the tabs are removed so that the child can be placed on the toilet, the unsoiled diaper must be discarded because the currently available tabs are for a single use only and usually tear the backing fabric when they are pulled away.

A variety of disposable panties are known. See, for example, U.S. Pat. Nos. 3,424,162; 3,599,638; 3,599,640, and 3,636,953. Such panties are provided with or adapted to receive a sanitary napkin in the crotch portion of the panty, and are not adapted to deal with the liquid strikethrough problem encountered during the training period or with incontinent adults or children. Similary, the disposable panty types disclosed in U.S. Pat. Nos. 3,663,962; 3,245,407 and 3,488,778, do not satisfy the need for a disposable training panty, because the panties are either non-absorbent, such as plastic, or lack the necessary fit in the leg and waist area to prevent the problem of liquid strikethrough and leakage.

Furthermore, such panties are of rather complex construction, causing the cost per unit to be too high for disposable items.

SUMMARY OF THE INVENTION

The disposable undergarment of this invention, on the other hand, is particularly well adapted to be used as a training panty during the training period. The undergarment is very simply constructed of one or more plies of stretchable non-woven fabric. Preferably, several plies of stretchable, non-woven fabric are utilized to provide different absorption and moisture-permeability characteristics for the inner and the outer layer of the undergarment, as well as good conformability and fit without attendant bulkiness. The inner, or facing, layer of the undergarment provides an innermost ply having a soft surface for contact with the wearer's skin, readily permits passage of excreted body liquids therethrough, and can provide an absorbent mass for body liquids as well, if desired. The outer, or backing, layer of the undergarment, on the other hand, presents at least one ply which is an effective liquid barrier and which prevents or substantially minimizes body liquid strikethrough. In a preferred embodiment of this invention, the non-woven outer fabric layer, as well as the non-woven inner fabric layer, are micropleated in the machine direction of the fabric and compacted in the cross-direction of the fabric to give enhanced stretch or extensibility characteristics.

The preferred disposable undergarment comprises two stretchable, non-woven fabric layers having one or more plies each, preferably compressively-shrunk non-woven fabrics. An absorbent layer or panel can be disposed between the inner and outer layers of the undergarment. The undergarment has a self-fitting waist aperture and is self-fitting about the legs.

Fabric blanks for manufacturing the undergarment of this invention are laid out and cut to provide a substantially rectangular shape of which one longer side margin is adapted to become the waist encircling portion of the undergarment, and the other side margin is adapted to become the leg openings upon the joining of the end margins one to another. Joining all layers of the fabric together in the crotch area provides leg apertures when an undergarment is formed from the blank. Elasticity is imparted to the waistband portion and the leg openings of the undergarment by use of a thermoplastic, heat-sealable elastic material which can be laid down along the side margins of the blank, stretched, retained in a stretched condition during heat-sealing, and then allowed to relax after the heat-sealing process, gathering at least a portion of the fabric in these regions. Fit in the waistband area and the leg area is enhanced by cutting the blanks from a cross-compacted and micropleated fabric so that the micropleats run parallel to the end margins of the blank, that is, from the waistband edge to the leg openings edge, and the compaction runs substantially parallel to the micropleats.

A further feature of the preferred disposable undergarments of this invention is the seam construction for joining the end margins of the undergarment to form the waist aperture and the opening for formation of the leg apertures. According to this feature, the end margins of a pair of superimposed blanks are overlapped and joined so that the seam comprises only three ply thicknesses at any given location along the seam. That is, in the overlapping region, one of the outer plies abuts one of the inner plies while the other outer ply and the other inner ply extend from opposite sides over the abutting plies.

The resulting product not only provides an undergarment which minimizes liquid strikethrough problems while at the same time improving fit around the waist and leg areas, but does so with a novel arrangement of components which give the feel of a more costly cloth garment while being sufficiently inexpensive to be disposed of after a single use. Thus, the garment of the present invention solves many of the problems inherent in the past, and constitutes a significant advance in the art.

BRIEF DESCRIPTION OF THE DRAWINGS

The present invention will be further illustrated by reference to the following detailed description taken in conjunction with the accompanying drawings in which.

DETAILED DESCRIPTION OF THE PREFERRED EMBODIMENT

Figure 1:
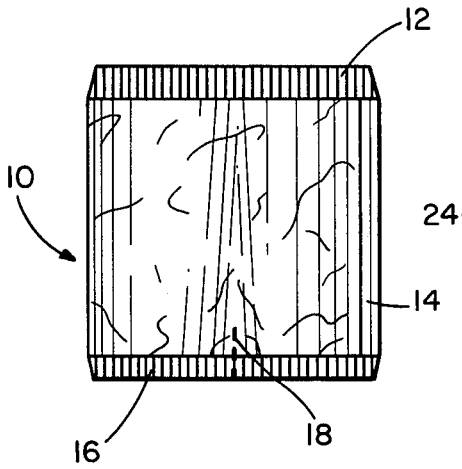
FIG. 1 is a front elevational view of a disposable training panty embodying this invention.

The present invention provides a disposable training panty which is adapted to be used during the training period of an infant. The baby training panty is preferably constructed from a light-weight, non-woven fabric formed predominantly of short-length cellulosic fibers with a minor percentage of long fibers in a non-woven web of the type disclosed in U.S. Pat. No. 3,663,348 to Liloia et al. Other non-woven webs that can be used are the so-called transition webs manufactured by the process disclosed in U.S. Pat. No. 3,768,118 to Ruffo et al. Other suitable webs are carded or spunbonded, long-fiber, non-woven webs such as those disclosed in U.S. Pat. No. 3,815,602 to Johns et al. It is preferred that thermoplastic fibers be included in the webs, so that the undergarment may be assembled by heat sealing techniques, as will hereinafter be discussed.

Prior to being cut into a blank suitable for use in the construction of the baby panty of this invention, the non-woven web can be made stretchable by compressive shrinking, preferably by compacting the fabric in the cross direction and micropleating in the machine direction, so that the extensibility to rupture preferably is at least about 30% and more preferably greater than about 55%, in the machine direction, and preferably at least about 40%, and more preferably greater than about 60%, in the cross direction. Such a fabric will be hereinafter referred to as a compressively-shrunk fabric.

Compressively shrunk non-woven fabrics can be made by subjecting a non-woven fabric web to creping, micropleating, rubber felt compressing, or compacting in either the machine direction or the cross direction of the fabric. For optimum stretchability or extensibility, the fabric web can be subjected to a combination of two or more of the aforementioned treatments. For the purposes of the present invention a particularly preferred compressively shrunk fabric is one which has been compacted in the cross direction by passage through nested bowed rolls of the type shown in U.S. Pat. No. 3,171,579 to Robertson and thereafter micropleated according to the teachings of U.S. Pat. No. 3,390,218 to Painter et al and U.S. Pat. No. 3,556,921 to Painter et al. After micropleating, the compressively shrunk fabric exhibits a plurality of discontinuous pleats across the width of the fabric, which pleats are made up of relatively smaller pleats interrupted in the transverse direction of the fabric by relatively larger pleats. When used in the product of this invention, the micropleated compressively shrunk fabric is turned 90° from the machine direction and a pleat pattern of relatively smaller pleats and relatively larger pleats extends across the fabric length, each of the relatively larger pleats having adjacent thereto a relatively smaller pleat both in the longitudinal and in the transverse directions. Stated in another way, each relatively longer pleat is separated from the nearest pleat of substantially the same size by a relatively smaller pleat. One surface of the micropleated web is a puffed surface and the other surface is a ribbed surface having a relatively softer hand. Micropleated fabrics generally have about 8 to about 20 micropleats per inch.

Referring to FIG. 1, in a preferred embodiment, a baby training panty 10 is of multilayered construction having a waist encircling portion 12, a side seam 14 where the end margins of a blank were joined, a side margin 16 forming an opening for the leg apertures, and a means 18 for securing all layers of fabric together to create individual leg apertures. The means 18 for securing the fabric together may be glue lines or intermittent spots of glue or stitching or heat sealing or the like.

Figure 2:
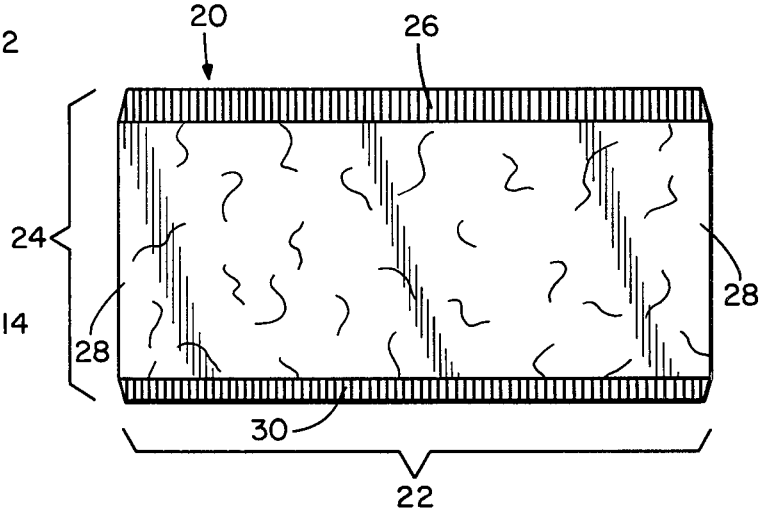
FIG. 2 is a plan view of a blank suitable for making the disposable training panty illustrated in FIG. 1.
Figure 2A:
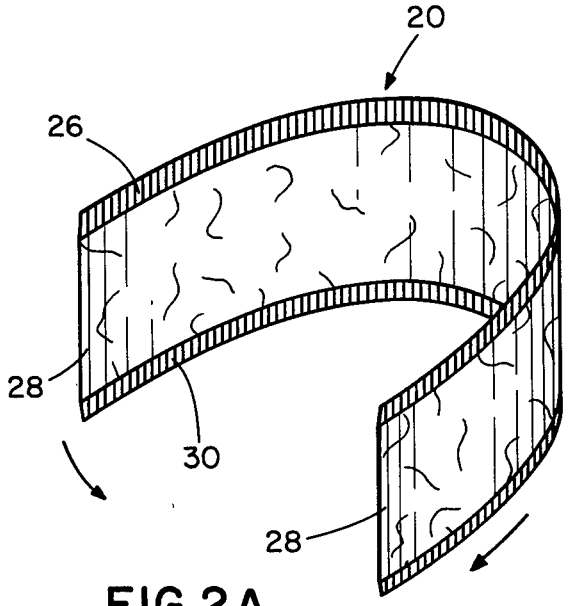
FIGS. 2A and 2B are perspective views illustrating the use of the blank in FIG. 2.
Figure 2B:
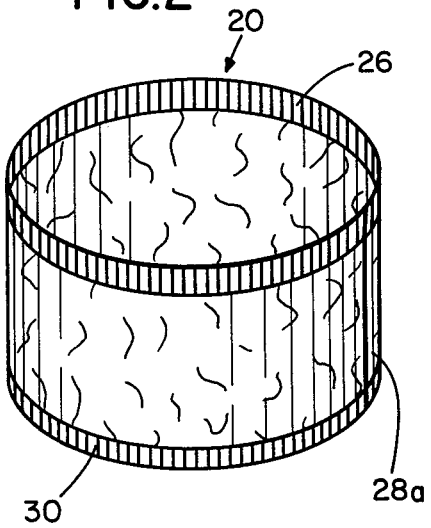

Baby training panty 10 is constructed from paired superimposed fabric blanks such as the stretchable integral blank 20, which is shown in FIG. 2, to be a substantially rectangular member having a length dimension 22 greater than the width dimension 24. The stretchable integral blank 20 is a pair of blanks which form the inner and outer layers of the panty garment, both blanks being identical in size and shape. FIGS. 2, 2A and 2B show that the blank 20 uses the length dimension 22 for the waist portion 26 and the leg apertures portion 30. The width dimension 24 is used for the seam 28A of FIG. 2B. In constructing the training panty, the ends 28 are brought together and secured to form seam 28A. In order to form the leg apertures portions 30, it is necessary to secure all fabric layers together in the central portion as shown at securement means 18 in FIG. 1.

In order to provide the desired stretch in the waistband and leg areas, blank 20 is cut from a micropleated, cross-compacted non-woven fabric web so that the micropleats are parallel to the side seam 28A shown in FIG. 2B. The cross-compaction runs substantially normal to the direction of micropleating.

Figure 3:
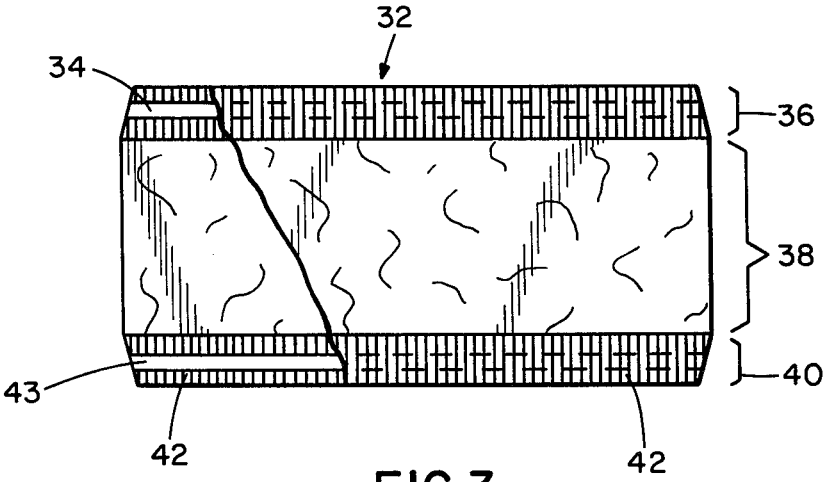
FIG. 3 is a plan view of the blank of FIG. 2 showing a portion broken away to illustrate the layers in the blank.

Referring now to FIG. 3, blank 32 is shown in a fragmentary view wherein the waistband elastic 34 is shown. The waistband elastic 34 and leg portions elastic 43 are secured between two layers of micropleated fabric and provides gathering in regions 36 and 40. The central portion 38 is comprised of two layers of micropleated fabric which may or may not be adhered to each other. In the length dimension portion 40 the two layers are adhered one to the other so as to provide a suitable margin to form leg apertures.

Figure 4:
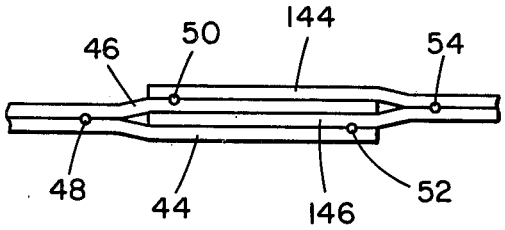
FIG. 4 is a cross-sectional view of a suitable seam construction.
Figure 5:
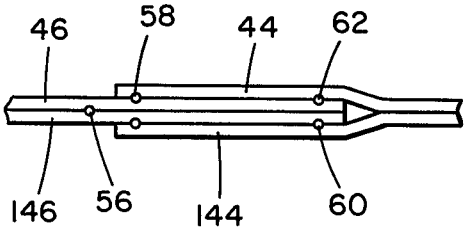
FIG. 5 is a cross-sectional view of another suitable seam construction.

Referring to FIGS. 4 and 5, the panty seam whether it be placed on the side or in the front, can alternatively be constructed by alternately lapping margins 44, 46, 144 and 146 or by lapping margins 44 and 144 over sandwiched edges 46 and 146, it being understood that margins 46 and 146 could overlie sandwiched margins 44 and 144 and the order of lapping illustrated in FIG. 4 could be reversed, if desired. The seam is then secured with glue lines such as lines 46, 48, 50 and 52 in FIG. 4 and glue lines 56, 58, 60 and 62 in FIG. 5. An asymmetric blank is not necessary for these two seam constructions.

Figure 6:
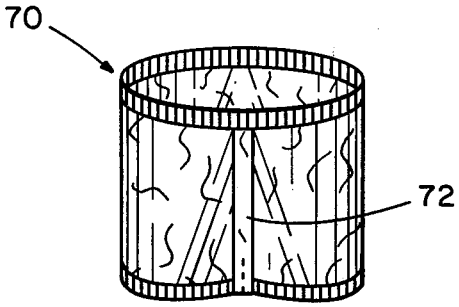
FIG. 6 is a perspective view of a disposable training panty embodying this invention.

In an alternate embodiment as shown in FIG. 6, the training panty 70 of this invention is constructed from a blank such as that shown in FIG. 2 but the seam 72 is located in the center of the front rather than on the side. Securement of all layers together 74 forms the leg apertures.

Figure 7:
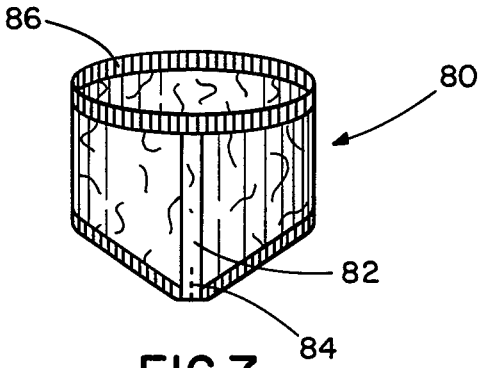
FIG. 7 is a perspective view of another embodiment of the present invention.
Figure 8:
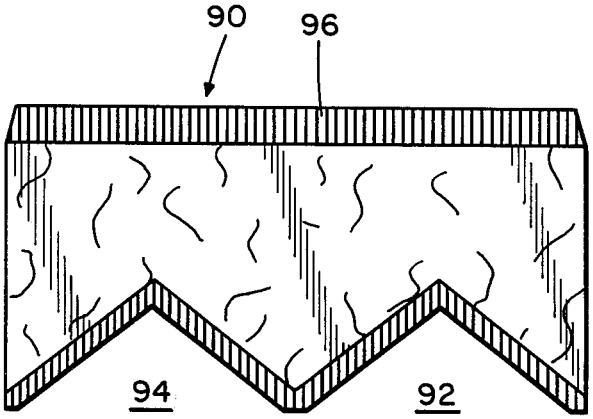
FIG. 8 is a plan view of the blank suitable for making the training panty of FIG. 7.

A further embodiment is shown in FIG. 7. In constructing a training panty 80, in accordance with this invention, a contoured blank 90, as shown in FIG. 8, is utilized placing the seam 82 in the center of the front. Securement means 84 provides the leg apertures. The cut-out portions 92 and 94 as shown in FIG. 8 provide a tapering of the leg apertures in the final panty as is seen in FIG. 7. A portion of the waistband 86 in FIG. 7, 96 in FIG. 8, and the leg portions 85 in FIG. 7 and 95 in FIG. 8, is gathered to provided improved fit.

Figure 9:
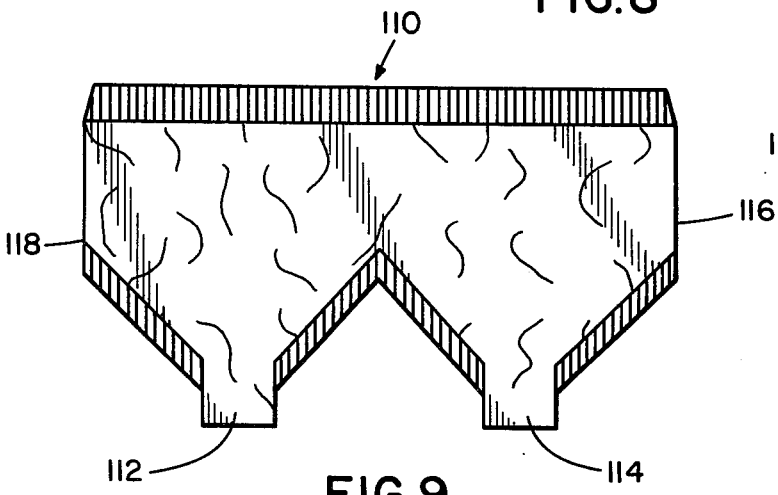
FIG. 9 is a plan view of the blank suitable for making the training panty of FIG. 10.
Figure 10:
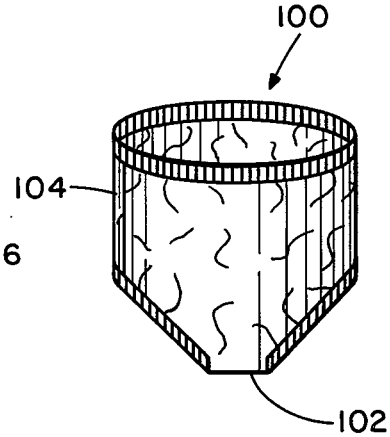
FIG. 10 is a perspective view of another embodiment of the present invention.

A still further embodiment is shown in FIG. 10. In constructing a training panty 100 in accordance with this embodiment, a contoured blank 110 as shown in FIG. 9, is laminated not only at the side seams 116 and 118, but also in the crotch area at points 112 and 114. The resulting, training panty has a side seam 104 (FIG. 10) and a crotch area 102.

The disposable undergarments of the present invention may be made from a single layer non-woven web fabric, or as described may be made from two or more layers or plys. The outer ply of the undergarments of this invention can be inherently hydrophobic as manufactured. On the other hand, the outer ply can be an inherently hydrophilic web which is treated so as to be moisture-repellent or moisture-impervious, for example, by spraying the outer layer with a hydrophobic agent. Suitable agents include the cellulose-reactive sizing agent emulsions like those sold by Hercules, Inc. under the tradename "Aquapel" and the like. A stretchable plastic film can additionally be provided overlying the outer ply as an additional moisture barrier, if desired.

Preferably the facing layer of the undergarment, i.e., the layer contacting the wearer's skin, is non-wettable even though this layer is moisture permeable. To this end the facing layer can be made of a non-woven fabric which contains synthetic hydrophobic fibers or hydrophobic binders for the non-woven fabric, or the layer can be treated before or during undergarment manufacture with small amounts of a suitable hydrophobic agent. Preferred webs are those disclosed in U.S. Pat. No. 3,663,348.

The foregoing description and the drawings are intended as being illustrative and are not to be taken as limiting.

Still other variations within the spirit and scope of this invention are possible and will present themselves to one skilled in the art.

I claim:

1. A unitary disposable undergarment suitable for use in training infants, constructed from at least one layer of a non-woven fabric having throughout its area discontinuous micropleats, said fabric being substantially rectangular in shape having longer side margins and shorter end margins, said micropleats extending generally parallel to said end margins, one of said side margins forming a waist encircling portion by joining one end margin of the other end margin, the other of the said side margins containing an elastomeric member forming leg openings by joining all layers of non-woven fabric together in the crotch area.

2. The disposable undergarment of claim 1 wherein the elastomeric member is secured around at least a portion of said waist encircling portion.

3. The disposable undergarment of claim 2 wherein the elastomeric members are strips of thermoplastic elastomer.

4. The disposable undergarment of claim 1 wherein at least another layer of said non-woven fabric is laminated to the first layer and in the same shape and size as the first layer to provide a multilayer disposable undergarment, wherein the first layer of non-woven fabric is placed next to the wearer's skin.

5. The disposable undergarment of claim 4 wherein the first layer of non-woven fabric is substantially less moisture repellent than any other subsequent layers.

6. The disposable undergarment of claim 1 wherein the layers in the crotch area are joined in such a manner that the end margins when joined provide a side seam in the undergarment.

7. The disposable undergarment of claim 1 wherein the layers in the crotch area are joined in such a manner that the end margins when joined provide a front seam in the undergarment.

8. The disposable undergarment of claim 1 wherein the end margins and the layers in the crotch area are joined by means of thermoplastic elastomeric beads.

9. A unitary, multilayer disposable undergarment including a waist encircling portion and leg openings comprising: a moisture-permeable first layer adapted to be positioned adjacent the wearer's skin; a second layer adapted to be disposed outwardly when the undergarment is worn, said second layer being dimensionally similar to said first layer and positioned in superimposed relationship with respect to said first layer, said second layer being more moisture repellent than said first layer; at least one of said layers being a non-woven fabric having throughout its area discontinuous micropleats extending generally parallel to a longitudinal center line extending generally perpendicular to said waist encircling portion so as to provide an extensibility to failure of at least about 30%, said micropleats defining a ribbed surface on one side of said non-woven fabric and a puffed surface on the opposite side of the non-woven fabric; the other of said layers having stretch characteristics similar to those of said one layer; means securing said layers to one another in the waist encircling portion; means securing all layers together in the crotch area to form leg openings; and gathering means associated with the waist encircling portion and the leg openings.

10. The disposable undergarment of claim 9 wherein elastomeric members are secured around at least a portion of said waist encircling portion and at least a portion of said leg openings.

11. The disposable undergarment of claim 10 wherein said elastomeric members are strips of thermoplastic elastomer.

12. The disposable undergarment of claim 9 wherein the end margins when joined provide a side seam in the undergarment.

13. The disposable undergarment of claim 9 wherein the securing means are thermoplastic elastomeric beads.

14. A unitary, multilayer, disposable undergarment suitable for use in training infants or by incontinent children or adults constructed from a non-woven stretchable fabric, said fabric being substantially rectangular in shape having longer side margins and shorter end margins, one of said side margins forming a waist encircling portion by joining one end margin to the other end margin, the other of said margins forming leg openings by joining all layers of non-woven fabric together in the crotch area, said undergarment having a moisture-pervious inner layer of stretchable fabric adapted to contact the wearer's skin, a moisture-impervious stretchable outer layer and an intermediate liquid absorbent panel disposed therebetween, said undergarment having gathering means associated with the waist encircling portion and the leg openings.

15. The disposable undergarment of claim 14 wherein elastomeric members are secured around at least a portion of said waist encircling portion and at least a portion of said leg openings.

16. The disposable undergarment of claim 15 wherein said elastomeric members are strips of thermoplastic elastomer.

17. The disposable undergarment of claim 14 wherein the end margins when joined provide a side seam in the undergarment.

18. The disposable undergarment of claim 14 wherein the end margins and the layers in the crotch area are joined by means of thermoplastic elastomeric beads.

* * * * *